United States Patent [19]
MacCarthy

[11] 4,318,243
[45] Mar. 9, 1982

[54] PRECESSION-RESISTANT YO-YO DEVICE

[75] Inventor: Patrick MacCarthy, Golden, Colo.

[73] Assignees: Ramon E. Bisque; Franklin J. Stermole, both of Golden, Colo.

[21] Appl. No.: 178,628

[22] Filed: Aug. 15, 1980

[51] Int. Cl.[3] ..... A63H 27/12
[52] U.S. Cl. ..... 46/61
[58] Field of Search ..... 46/61, 60, 48, 49, 50; 433/110

[56] References Cited

U.S. PATENT DOCUMENTS

| | | | |
|---|---|---|---|
| D. 142,317 | 8/1945 | Elfmont | 46/61 UX |
| 515,816 | 3/1894 | Browne | 433/110 X |
| 651,469 | 6/1900 | Pieper et al. | 433/110 X |
| 1,250,266 | 12/1917 | Bans | 46/50 |
| 1,949,858 | 3/1934 | Brown | 46/61 |
| 2,380,301 | 7/1945 | Gavriles | 46/61 |
| 2,773,328 | 12/1956 | Fraenkel et al. | 46/61 |
| 2,975,547 | 3/1961 | Greve | 46/11 |
| 3,175,326 | 3/1965 | Isaacson | 46/61 |
| 3,207,508 | 9/1965 | Klemke | 46/61 X |
| 3,228,140 | 1/1966 | White | 46/61 |
| 3,256,635 | 6/1966 | Radovan | 46/61 |
| 3,263,361 | 8/1966 | Bowden | 46/61 |
| 3,362,101 | 1/1968 | Grow | 46/61 X |
| 3,712,271 | 1/1973 | Greathouse | 119/96 |
| 3,858,348 | 1/1975 | Brown | 46/61 |
| 4,086,722 | 5/1978 | Brown | 46/61 |

FOREIGN PATENT DOCUMENTS

| | | | |
|---|---|---|---|
| 2024435 | 12/1971 | Fed. Rep. of Germany | 46/61 |
| 1151081 | 1/1958 | France | 433/110 |
| 1408251 | 10/1975 | United Kingdom | 46/61 |

OTHER PUBLICATIONS

"Experimental Fun With the Yo-Yo and Other Science Projects", Renner, Al G., Dodd, Mead & Co., N.Y. ©1979.

*Primary Examiner*—Gene Mancene
*Assistant Examiner*—Mickey Yu
*Attorney, Agent, or Firm*—Sughrue, Mion, Zinn, Macpeak and Seas

[57] ABSTRACT

A string-supported device capable of simultaneous rotation about its own axis, translational motion and orbital motion. An axle consisting of two segments, both axle-segments connected together, either directly or indirectly, and each axle-segment capable of rotating independently of the other axle-segment. Two discs are connected through their centers to each of the two axle-segments. Opposite ends of a single string are connected to each axle-segment, and the string is looped over a support member upon which it can readily slide. The support member is connected to a swivel system which is in turn connected to a ring. In order to operate the device the string is first wrapped in opposite directions around each axle-segment, and the body of the yo-yo is allowed to fall while the operator is holding the ring. An up-and-down motion of the yo-yo device is thus initiated. The two halves of the device rotate in opposite directions, thus leading to an automatic compensation of gyroscopic precession, and an avoidance of the common problems which plague the conventional yo-yo and prior modifications thereof.

22 Claims, 10 Drawing Figures

PRECESSION-RESISTANT YO-YO DEVICE

BACKGROUND OF THE INVENTION

1. Field of the Invention

This invention relates to the field of rotating toys. More specifically, this invention relates to a yo-yo device, consisting of an axle, said axle being composed of two axle-segments, each axle-segment being connected to, but capable of rotating independently of, the other axle-segment; the axle-segments may be interconnected directly or indirectly; one or more discs centrally connected to each axle-segment; a single looped string having one of its ends attached to one axle-segment, and the opposite end of said string attached to the other axle-segment; said looped string being slidably supported over some support means.

2. Description of the Prior Art

A survey of the prior art reveals various toys having combined rotational motion about a horizontal axis and a translational motion in a vertical direction. One type of such toy is commonly referred to as a yo-yo. This toy has also been referred to as a return top; prince of Wales' toy; disc; Incroyable; Bandalore; or emigrette. A conventional yo-yo consists of a single axle having two parallel positioned discs centrally connected to the axle. A string is connected to the axle between the discs at one end and is held in the user's hand at the other end. The string is wrapped around the axle by the user and then is forced downward, or allowed to fall downward. During descent of the yo-yo body, the string unwinds, providing an angular momentum to the discs. Once the string has been completely unwound, the angular momentum of the discs continues to exist, thus causing the string to be rewound around the axle in the opposite direction as it travels upward vertically toward the user's hand. In another variation of the conventional yo-yo, the string is not actually tied to the axle; rather, the axle rests in the loop of the string which is doubled back upon itself. The conventional yo-yo structure is disclosed within U.S. Pat. No. 3,263,361 to Bowden, and U.S. Pat. No. 3,256,635 to Radovan.

The conventional yo-yo as described above has achieved tremendous success in the past as an entertaining toy. Furthermore, certain modifications of that conventional yo-yo such as that disclosed within Bowden may have achieved success as entertaining toys. However, the conventional yo-yo structure has a pronounced limitation when used by inexperienced or younger operators. This limitation is apparent to even the most casual observer and resides in the difficulty of maintaining the balance or equilibrium of the toy during use. The inability of the inexperienced user to maintain this balance results in wobbling and precessional motions of the yo-yo during use. The operator loses control of the yo-yo when the balance of the toy is disturbed, thus causing the yo-yo to slow its rotational motion and thereby lose its ability to maintain vertical translational motion. When the operator loses control of the yo-yo it generally undergoes a severe precessional motion about a vertical axis, that is, it spins rapidly about a vertical axis. All yo-yos available up to the present time exhibit this precessional rotation to a pronounced extent.

My copending U.S. patent application Ser. No. 120,289 was filed Feb. 11, 1980, and my copending U.S. patent application Ser. No. 138,729 was filed Apr. 9, 1980; both of those patent applications also relate to yo-yo devices. Prior attempts at modifying the conventional yo-yo structure are also disclosed within U.S. Pat. No. 3,207,508 to Klemke and U.S. Pat. No. 3,228,140 to White. The modification of Klemke and White may provide additional temporary horizontal stability to the axle by attaching two separate strings to the yo-yo at two separate points. However, those devices make no provision for the possibility of one of the strings being wound around the axle more quickly than the other, thus resulting in tilting. That problem is considered and solved in the invention of MacCarthy, U.S. patent application Ser. No. 120,289 filed Feb. 11, 1980. Another invention by MacCarthy, described within U.S. patent application Ser. No. 138,729 filed Apr. 9, 1980 describes an alternative method for enhancing the stability of the yo-yo.

Other modifications to conventional yo-yo structure have been developed within the prior art. These modifications include the addition of metal rings to the discs of the yo-yo. Some of the modifications have been directed towards improving the stability of the yo-yo. Other modifications to the conventional yo-yo structure do not have as their primary purpose the improvement of the stability of the yo-yo, but rather the development of a toy having added versatility and function, thus requiring greater skill and manual coordination for its operation.

Accordingly, the prior art appears to be comprised of yo-yo toys of conventional structure, conventional yo-yos with slight aesthetic modifications, yo-yos whose structure has been modified with the intent of providing improved stability, and yo-yos whose conventional structure has been modified with the intent of providing additional versatility and function. The structure of the present invention removes it from being classified strictly as a conventional yo-yo. Although the present invention may be modified aesthetically to produce graphic, light and sound effects, the structural differences between the present invention and a conventional yo-yo indicate that the present invention is more than a mere modification of conventional structure intended to bring out merely aesthetic differences over a conventional yo-yo.

All previous yo-yo designs undergo precession about a vertical axis if the yo-yo is swung sideways, that is, in a direction parallel to the axis of the yo-yo. The yo-yo of the present invention is unique, and differs from all previous yo-yo designs in that the precessional rotation is either totally eliminated or vastly minimized. This property of resisting precessional motion is the single most important feature of the yo-yo device embodied in the present invention.

Although the structure of the present invention was intended to and did result in total or almost total elimination of precessional rotation, the present invention is also capable of certain increased versatility of function over a conventional yo-yo and prior modifications thereof.

In the context of this Specification the term 'precessional stability of yo-yo' is intended to mean the resistance of the yo-yo to going out of control, and its ability to resist precessional rotation.

As an indication of the enhanced precessional stability inherent in the yo-yo of the present invention, the following, illustrative examples may be given:

It should first be pointed out, however, that there are two primary modes in which the yo-yo of the present invention can be operated. In one mode, where the string is wrapped around the two axle-segments in the same directions, the yo-yo possesses all of the advantages inherent in my previous invention, described within U.S. patent application Ser. No. 120,289. The alternative mode of operation is totally unique to the present invention and this special capability constitutes the primary objective which led to this invention. In this unique mode of operation, where the string is wrapped about the two axle-segments in opposite directions, the yo-yo of the present invention may be swung vigorously sideways, that is in a direction parallel to the axis of the yo-yo, without experiencing a significant precessional rotation. Accordingly, the sideways swing does not inhibit the combined rotational-translational motion of the yo-yo, and the proper functioning of the yo-yo is constantly maintained; the yo-yo simply does not go out of control since it cannot experience precessional rotation.

As a further indication of the enhanced precessional stability inherent in the yo-yo of the present invention, the user will find that after minimal practice, it is possible to sustain the combined rotational-translation motion of the yo-yo while it is simultaneously being swung in a circular or orbital manner. This combined rotational-translational-orbital motion can be continued indefinitely, during which time the yo-yo successively approaches and departs from the operator's hand, and the orientation of the stretched string in space is continually changing. The plane of the orbital motion may be changed continually without disturbing the functioning of the yo-yo, that is, the circle or orbit may occur about a horizontal axis, a vertical axis, or about any other axis; and this axis may be changed rapidly by the operator during use, without upsetting the yo-yo motion. The combined translational motion of the yo-yo along the direction of the string, toward and away from the operator's hand, and the orbital motion of the yo-yo about the operator's hand, results in a net spiralling motion of the yo-yo body. The orientation of the body of the yo-yo relative to the operator is not a critical factor during the orbital swings of the yo-yo. The yo-yo can withstand very rough treatments during operation without going out of control. This type of precessional stabilitly is totally foreign to the conventional yo-yo and all prior modifications thereof.

In addition to demonstrating precessional stability, the above examples also serve to illustrate the increased versatility of the present yo-yo. It is capable of more versatile types of motion than all other types of yo-yos. Furthermore, the combined rotational-translational-orbital motion achievable with the yo-yo of the present invention does not require a great deal of skill on the part of the yo-yo operator; the ability to operate this new yo-yo can be rapidly learned. The yo-yo device of the present invention is unique in that it totally avoids precessional problems experienced by all prior yo-yo designs.

SUMMARY OF THE INVENTION

The presently claimed invention is comprised of an axle consisting of two axle-segments. In a preferred embodiment of the present invention, the two axle-segments lie on a common axis. Except where explicitly stated to the contrary, this is the embodiment which is referred to in this specification. The two axle-segments are directly or indirectly interconnected and can rotate about the common axis independently of each other. One or more discs are connected at their centers to each of the two axle-segments. Accordingly, the discs which are mounted on one axle-segment can rotate independently of the discs which are mounted on the other axle-segment. More specifically, one axle-segment and the disc or discs mounted thereon, may rotate in the same or in the opposite direction to the other axle-segment and its associated disc or discs. A single looped string, having one end attached to one axle-segment and the opposite end attached to the other axle-segment, lies on a support upon which the string may readily slide. In order to operate the yo-yo, the user may hold the support over which the string is looped and move that support gently up and down. The operator's finger may serve as the support.

If the string segments on opposite sides of the support member are wound around the two axle-segments in the same sense, the device can be operated in the same manner as the looped-string pulley-supported yo-yo described in my copending U.S. patent application Ser. No. 120,289. However, a totally unique type of yo-yo operation can be achieved with the present device by wrapping the string segments about the two axle-segments in opposite directions. This causes the two yo-yo segments and attached discs to rotate in opposite directions at all times, a type of motion not possible with any prior art yo-yo design. This opposite rotation for the two yo-yo sections has very unique advantages for the yo-yo motion. This is best explained by first referring to the behavior of a conventional yo-yo. Consider a conventional yo-yo rotating clockwise about an axis of rotation which is along your direction of vision. If the yo-yo body is thrown forward, away from you, a torque is applied to the body of the yo-yo tending to topple it; the far disc of the yo-yo tends to rise and the near end tends to dip; this torque results in a clockwise gyroscopic motion of the yo-yo body about a vertical axis, as the yo-yo is viewed from above. The direction of the precessional motion would be reversed if either the sense of the applied torque or the direction of the original rotation were reversed.

The yo-yo of the present invention has two equivalent sections rotating in opposite directions. When a torque is applied to this yo-yo which tends to change the orientation of the axis of the rotating yo-yo, one segment tends to precess in one direction, while the other segment tends to precess in the opposite direction. Both tendencies compensate each other with the net result that gyroscopic precession is totally eliminated, or is present to only a negligible extent.

In a preferred embodiment of the present invention, the string is looped over a pulley, sheave or grooved wheel, which then serves as the support member. The pulley is rotatably mounted on a frame member which is in turn connected to a swivel system which is attached to a holding ring. In order to operate the preferred embodiment of the present invention, the user places his finger through the ring. After winding the ends of the string in opposite directions about the axle-segments, the body of the yo-yo is allowed to fall. Thereafter, gently up and down oscillatory motion is maintained in order to keep the sections of the yo-yo body rotating in opposite directions, thus maintaining its vertical up-and-down motion. The two axle-segments continue to rotate in opposite directions at all times. The axis of the yo-yo is maintained horizontal, by virtue of the pulley over which the looped string can readily slide, thus automatically eliminating any inequality which might tend to occur due to differences in the winding patterns of the string segments over the axle-segments.

In order to further increase the ease of operation of the present invention, a loop may be suspended just below the pulley. The loop is suspended from arms which extend from the frame member holding the pulley. The loop is smaller in diameter than the diameter of the discs comprising the yo-yo body. Accordingly, when the yo-yo rises to a point close to the pulley it is prevented from touching the pulley by the loop. Alternatively, this loop may closely surround the pulley; this does not prevent contact between the body of the yo-yo and the pulley, but does prevent the string from being knocked off the pulley.

In another embodiment of the present invention, the support member consists of two rings, held at a fixed distance apart by an interconnecting rod. The interconnecting rod is suspended at its center point. The single string is passed through these two rings and can readily slide through them during operation of the yo-yo.

The ease of operation of the device is further increased by the swivel system, consisting of one or more swivels, which is connected to the support member. The swivels allow relaxation of rotational tension in the string. This prevents the two downwardly extending sections of the string from becoming intertangled.

Another interesting feature of this new yo-yo design is its ability to remove ravels when the two string segments become twisted about each other. The distance between the support member and the body of the yo-yo is diminished slightly when the two string segments become twisted about each other. For this reason there is a gravitational energy factor favoring the removal of such twists when the yo-yo is being suspended vertically downward. Now, when the two yo-yo sections are rotating in opposite directions, friction between the sides of the disc and the string in the one yo-yo section, and the corresponding effect in the other yo-yo section, might tend to twist the string segments about each other. In practice, this is found not to be a serious problem when using discs of smooth surface. Of course, any such tendencies would be alternately reversed during successive cycles as the yo-yo sections change directions of rotation. In summary, the oppositely rotating yo-yo sections do not induce twisting of the string segments about each other. On the other hand, it is found that when such twists do occur, the oppositely rotating discs do significantly aid in the removal of the twist when they are rotating in the appropriate directions, while they do not aggravate the twisting when they reverse their directions. As a result, twists of the string segments about each other are rapidly and automatically eliminated.

The yo-yo of the present invention serves to illustrate gyroscopic precession, when the string segments are wrapped around both axle-segments in the same direction; and it shows how this precession can be eliminated by wrapping the string segments about the axle-segments in opposite directions. As a result, the device has value in the teaching of dynamics; it is a simpler and cheaper device for illustrating gyroscopic precessional principles than the bicycle-wheel-cum-rotatable-chair frequently used for this purpose in physics classes.

In accordance with the above-presented description of the invention, and a further description which will follow, it is the primary object of this invention to provide a device comprised of an axle, said axle consisting of two axle-segments, said axle-segments being directly or indirectly interconnected and capable of rotating independently of each other; one or more discs connected at their centers to each axle-segment.

Another object of the present invention is to present a yo-yo device, two halves of which can simultaneously rotate in opposite directions about the yo-yo axis.

Another object of the present invention is to provide a device as described in the preceding paragraph, which has, in addition, a single string having one end connected to one of said axle-segments, and the other end of said string connected to other said axle-segment.

Another object of the present invention is to present a yo-yo device as described in the preceding paragraph where the string is wrapped about the two axle-segments in opposite directions.

Another object of the present invention is to present a yo-yo device which resists gyroscopic precession.

Another object of this invention is to present a device possessing internal compensation of gyroscopic precession.

Another object of the invention is to present a yo-yo device which can be treated quite roughly during operation without upsetting or destroying the yo-yo operation.

Another object of the invention is to provide a yo-yo device which can be swung sideways, or can be swung in an orbital manner, while still maintaining proper yo-yo functioning.

Still another object of the present invention is to present a yo-yo device requiring relatively little skill to operate, such skill being readily learned in a minimal of time.

Yet another object of the present invention is to present a yo-yo device which resists gyroscopic precession so effectively that it results in a toy having greatly increased versatility of operation.

Another object of the present invention is to present a device having educational value in the teaching of dynamics in that it can be used to effectively demonstrate the phenomenon of gyroscopic precession, and also demonstrate how such precession can be eliminated or compensated while still maintaining rotational motion.

An additional object of the present invention is to present a device which has educational value in the teaching of certain aspects of dynamics, and which is considerably less expensive to produce than currently used commercial devices for illustrating these principles of dynamics.

A further object of the present invention is to present a yo-yo device which lends itself to ornamental and decorative features, which may be enhanced kinetically as a result of the two sections of the yo-yo body rotating in opposite directions; thereby giving the yo-yo device a more interesting and attractive appearance.

Another object of the present invention is to present a novel support means over which a single looped yo-yo string may be slidably supported.

A further object of the present invention is to present a novel support means to which two separate strings of a two-string yo-yo may be connected.

These and other objects and advantages of the present invention will become apparent to those skilled in the art upon reading the details of construction and use as more fully set forth below, reference being made to the accompanying drawings forming a part hereof wherein like numerals refer to like parts throughout.

DESCRIPTION OF THE PREFERRED EMBODIMENTS

Before the present precession-resistant yo-yo device is described, it is to be understood that this invention is not limited to the particular arrangement of parts shown, as such devices may, of course, vary. It is also to be understood that the terminology used herein is for the purpose of describing particular embodiments only; it is not intended to be limiting since the scope of the present invention will be limited only by the appended claims.

Figure 1:
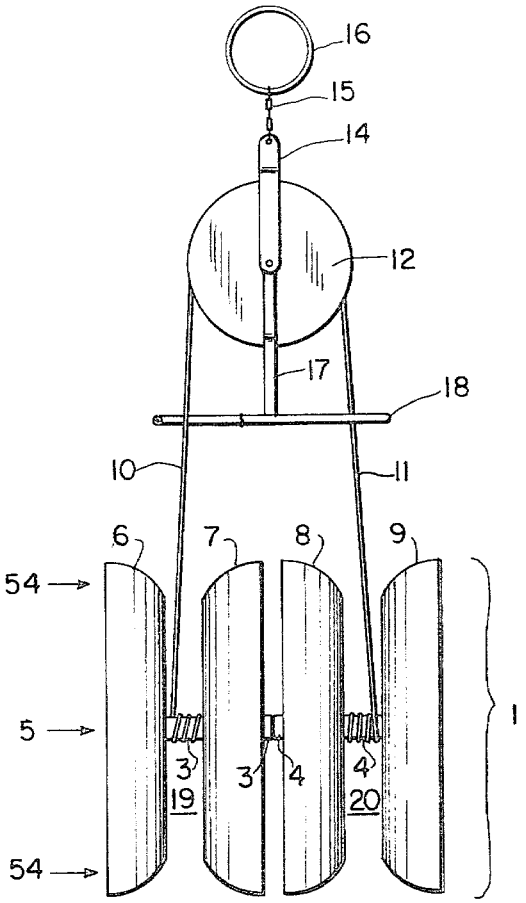
FIG. 1 is a plain front view of one embodiment of the present yo-yo device, showing the string wrapped around the axle-segments in opposite directions.
Figure 2:
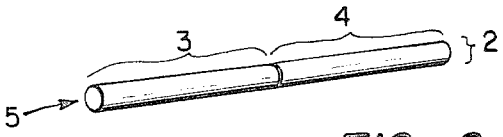
FIG. 2 is a view of the axle, showing two directly interconnected axle-segments which can rotate independently of each other.

Referring now to the drawings and to FIG. 1 in particular which shows a plain front view of the present invention. The body of the yo-yo is referred to generally by the number 1. The body 1 is comprised of an axle 2. FIG. 2 shows one embodiment of the axle 2. The axle 2 contains a first axle-segment 3 and a second axle-segment 4, positioned, in this embodiment, along a common axis 5. In the embodiment of the axle of the present invention illustrated in FIG. 2, axle-segment 3 is directly connected to axle-segment 4; axle-segment 3 can rotate about the axis 5 independently of axle-segment 4; axle-segment 4 can rotate about axis 5 independently of axle-segment 3. The axle 2 may be a type of sleeve-bearing, with axle-segments 3 and 4 loosely surrounding a common journal or bar; or alternatively, axle-segment 3 or axle-segment 4 may be permanently attached to the center journal or bar. The axle-segments 3 and 4 may or may not be supported on bearings. The yo-yo device of the present invention is greatly improved by having the two axle-segments 3 and 4 rotate as freely as possible. Two discs 6 and 7 are connected at their centers to axle-segment 3; and two discs 8 and 9 are connected at their centers to axle-segment 4, as illustrated in FIG. 1. The discs 6, 7, 8 and 9 are typically circular in cross-section. The inner discs 7 and 8 are typically equivalent to each other, but not necessarily so; the outer discs 6 and 9 are typically equivalent to each other. The inner discs 7 and 8, may or may not, be equivalent to the outer discs 6 and 9. The discs 6, 7, 8 and 9 may be hollow or solid, and their faces may be flat or curved.

Figure 3:
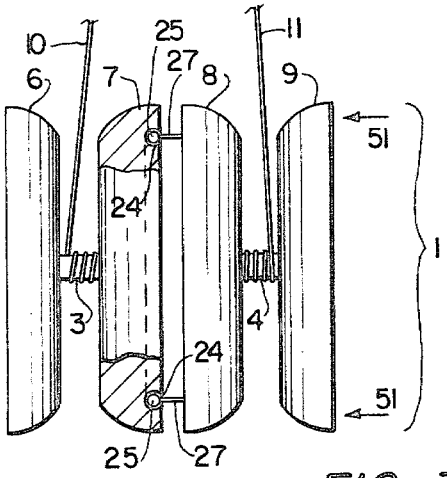
FIG. 3 is a plain front view of part of an alternative embodiment of the present invention.
Figure 4:
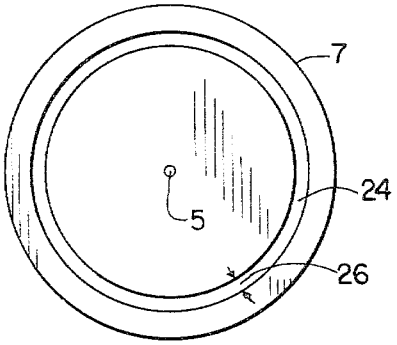
FIG. 4 shows a plain side-view of disc 7 of FIG. 3, showing the toroidal cavity 24, and looking in the direction of the arrows 51 of FIG. 3.

FIG. 3 illustrates an alternative embodiment of the yo-yo device. In FIG. 3, disc 7 is connected to disc 8 in the following manner. A toroidal or doughnut-shaped cavity 24 in disc 7 houses ball-bearings or roller-bearings 25. FIG. 4 shows a side view of disc 7, looking in the direction of the arrows 51 of FIG. 3. The toroidal cavity 24 intersects the surface of disc 7, leaving a circular opening of width 26. The ball-bearings or roller-bearings 25 are retained within the toroidal cavity 24, as the diameter of the bearings is greater than the width 26 of the circular opening of the toroidal cavity 24. Arms 27 are connected to bearings 25, in such a manner that the bearings 25 can rotate freely about the arms 27. The opposite ends of arms 27 are connected to disc 8. Disc 8, and attached disc 9, can then freely rotate independently of disc 7, and attached disc 6. During this rotation, ball-bearings or roller-bearings 25 travel around the toroidal cavity 24.

A single looped string having two string segments 10 and 11; string segment 10 is attached to axle-segment 3; and string segment 11 is attached to axle-segment 4. In one mode of operating the device, string segment 10 is wrapped around axle-segment 3 in the opposite sense that string segment 11 is wrapped around axle-segment 4, as illustrated within FIG. 1.

Prior to connecting both ends of the string 10, 11 to the axle-segments 3 and 4, the string 10, 11 is looped over the support member. In one embodiment, the support member consists of a pulley 12. After looping the string 10, 11 over the pulley 12, one end 10 of the string is attached to axle-segment 3 and the opposite end 11 of the string is attached to axle-segment 4. By referring to FIG. 5, it can be seen that the string 10, 11 lies in the trough 13 of the pulley 12.

The pulley, sheave or grooved wheel 12 is rotatably supported on a frame member 14.

A swivel system 15, consisting of one or more swivel members, is connected to the top of the frame 14. The swivel system 15 allows for rotational motion of the frame 14, and the attached pulley 12, string 10, 11 and yo-yo body 1. Attached to the other end of the swivel system 15 is a holding ring 16. The entire device may be held by the user by placing a finger through the ring 16.

Figure 5:
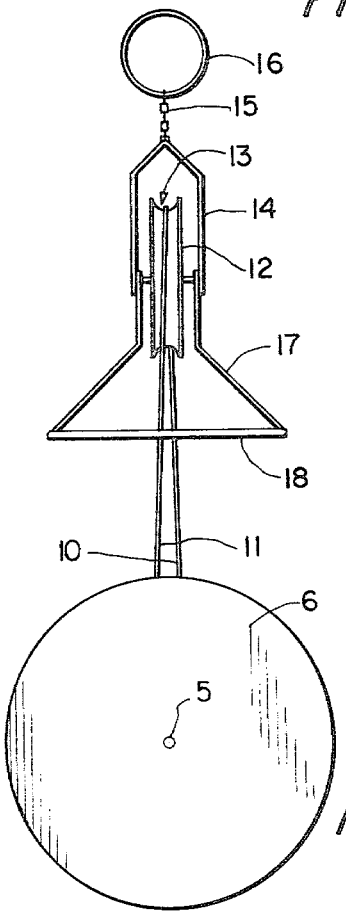
FIG. 5 is a plain side view of the present yo-yo device, looking in the direction of the arrows 54 of FIG. 1 and having the string wrapped around the axle-segments in opposite directions.

Arms 17 extend downwardly from the frame member 14, as illustrated in FIGS. 1 and 5. Supported from the ends of the arms 17 is a loop member 18. The loop member 18 has a diameter smaller than the diameter of at least one of the pairs of discs 6,9 or 7, 8. When the yo-yo is in use, the loop member 18 prevents the body 1 from striking the pulley 12. Accordingly, the loop member 18 aids in preventing the string 10, 11 from losing its position within the trough 13. Alternatively, instead of the loop 18 lying below the pulley 12, as illustrated in FIGS. 1 and 5, a loop may closely surround the pulley 12. In this case the arms 17 extend outwardly from the frame member 14. This alternative type or location of loop does not prevent the yo-yo body 1 from striking the pulley 12, but it does prevent the string from being displaced from the pulley trough 13, even when the yo-yo body 1 rises above the level of the pulley 12. FIGS. 1 and 5 illustrate a yo-yo device having one pulley; more than a single pulley may be incorporated into other embodiments of this invention.

Figure 6:
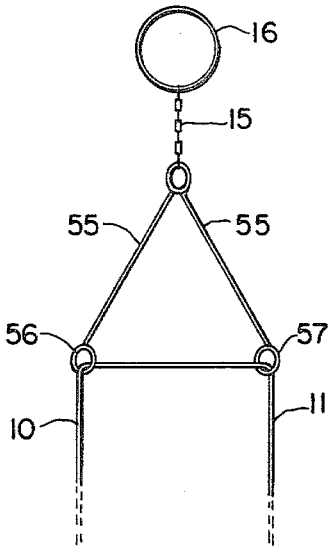
FIG. 6 illustrates another embodiment of the support means.

An alternative embodiment of the support member is illustrated in FIG. 6. Ring 56 is connected to one end of rod 55; ring 57 is connected to opposite end of rod 55. Rings 56 and 57 preferably lie in parallel planes, normal to the plane containing the rod 55. Rod 55 is suspended from swivel system 15 and holding ring 16. The single string is passed through the rings 56 and 57, and during operation of the yo-yo, the string can readily slide through these rings.

The string segments 10 and 11 may be wrapped in opposite directions around the axle-segments 3 and 4, in the following manner: holding the ring 16 in one hand, the yo-yo body 1 is suspended from the totally extended string segments 10 and 11. The body 1 of the yo-yo is placed on the ground, a table or some other flat surface. The yo-yo is then pulled forward, by pulling the ring 16. As the body 1 of the yo-yo rolls forward, the string segments 10 and 11 become wrapped in the same direction around the axle-segments 3 and 4. When the string is wrapped around the axle-segments in this manner, the yo-yo may be operated in the same way as described in U.S. patent application Ser. No. 120,289 for the looped-string pulley-supported yo-yo. However, the major advantage of the present invention arises from wrapping the string segments 10 and 11 in opposite directions around the axle-segments 3 and 4, as indicated in FIGS. 1 and 5. This can be conveniently and effectively implemented as follows: After the string segments 10 and 11 are wrapped around the axle-segments in the same direction, in the manner outlined above, the discs on one side of the yo-yo, say 6 and 7, are held firmly in one hand, the ring 16 is held in the other hand; the ring 16 is pulled in a direction away from the yo-yo body 1. This causes the string to be unwound from the axle-segment 4 and the discs 8 and 9 to rotate. The angular momentum of the rotating discs 8 and 9 causes discs 8 and 9 to continue rotating after the string has been completely unwound from the axle-segment 4, thus causing the string segment 11 to be wrapped around axle-segment 4 in the opposite sense to which it was wrapped initially, and also in the opposite sense to which the string is wrapped around axle-segment 3. One may continue to hold the ring 16 gently, while the string segment 11 is being rewound about axle-segment 4 in this manner. At the end of these simple operations, the string segments 10 and 11 are wrapped in opposite directions around axle-segments 3 and 4.

The ring 16 is simply a means for holding the yo-yo. The ring 16 is held in one's hand or a finger may be placed through the center of the ring 16. While holding the ring 16 in one hand, the body 1 is held in the other hand after the string segments 10 and 11 have been wrapped in opposite senses about the axle-segments 3 and 4. Operation of the device is initiated by letting the body 1 fall free while continuing to hold ring 16.

As the yo-yo body 1 falls under the influence of gravity the pairs of discs 6, 7 and 8,9 must rotate in opposite directions about the axis 5. When the yo-yo body 1 has reached the bottom of its swing, that is, when the string segments 10 and 11 are completely unwound, the angular momentum acquired by the discs causes them to continue rotating, thus winding the string segments 10 and 11 around the axle-segments 3 and 4 in the opposite direction to which they were previously wound. This causes the body 1 of the yo-yo to rise again. A gentle upward impuse, applied to the string 10, 11, just prior to the yo-yo body 1 reaching the bottom-most part of its swing, allows the up-down oscillation of the yo-yo body 1 to continue indefinitely. This applied impulse compensates for both frictional loss of energy and dissipation of the translational component of the energy which occurs at the bottom of the yo-yo swing, when the body 1 of the yo-yo is forced to change the direction of its translational motion.

During operation, the body 1 of the yo-yo may be swung vigorously sideways, that is in a direction parallel to the axis 5, without the operator losing control of the yo-yo. This is because the device does not undergo precession. All prior yo-yo designs would undergo severe gyroscopic precession about a vertical axis when treated in this manner, generally resulting in total loss of control over its motion. The device of the present invention is the only yo-yo design available where two halves of the yo-yo rotate in opposite directions; the tendency toward gyroscopic precession from one-half of the yo-yo is counteracted by the tendency toward gyroscopic precession in the opposite direction by the other half of the yo-yo. As a result of these opposing tendencies the device has internal compensation of gyroscopic precession.

The gyroscopic compensation inherent in the yo-yo device of the present invention not only allows the yo-yo body 1 to be swung sideways, as described above, but it also allows the yo-yo body 1 to be swung in an orbital fashion with the string 10, 11 acting as a radius. While the body 1 of the yo-yo is undergoing this orbital motion, it is simultaneously rotating about its axis 5 and translating in a direction toward and away from the operator's hand along the string 10,11. This combined rotational, translational, orbital motion can be continued indefinitely. This interesting and very versatile type of behavior is unique to the yo-yo of the present invention. The knack for carrying out this combined rotational-translational-orbital motion is readily learned and does not require an inordinate amount of skill on behalf of the operator.

It is not essential that the widths of the two grooves 19 and 20 be equal, or that the axle-segments 3 and 4 have the same diameter, or even that the two string segments 10 and 11 on opposite sides of the pulley 12 be equivalent in diameter. Neither is it critical that one side of the yo-yo body 1, comprising discs 6 and 7 and axle-segment 3 be exactly of the same weight as the other side comprising discs 8 and 9 and axle-segment 4. However, within the preferred embodiment, the above-mentioned corresponding parts are equivalent. The ability of the yo-yo device to function properly even when there are inequalities between these corresponding parts serves to demonstrate the lack of precision which can be tolerated in the manufacture of the present invention. The desire to maintain these corresponding parameters equal in the preferred embodiment does not serve to demonstrate any inferiority of the present invention over previous designs. Furthermore, it should be noted that it is not necessary that the diameter, weight or thickness of the outer discs 6 and 9 be equal to the corresponding parameters of the inner discs 7 and 8 in order for the device to work effectively.

The string 10, 11 may be comprised of a variety of elongated material. However, the inventor has discovered that limp, braided string is particularly well adapted for use in connection with the present invention. A conventional yo-yo string is laid, i.e., it has strands twisted about each other in one direction. While such a conventional yo-yo string can be utilized in connection with the present invention, it may lead to some difficulties. For example, during the operation of the yo-yo, the two string segments may come into contact and twist around each other. When using a conventional yo-yo string, if this tangling occurs, there is a strong preferential tendency for the twisting of the two string segments about each other to continue in the direction which causes unwinding of the twists in the original laid string. This makes it more difficult to unravel the string. This propensity towards twisting in one particular direction does not exist with a non-laid string.

It should be further pointed out that monofilament nylon can be utilized. However, monofilament nylon has a tendency to snap. Very limp, braided nylon has been found to be very effective when used in connection with the present invention. Another useful feature of the limp, braided string in connection with the present invention is the ability of the two string portions to readily slide over each other when twisted around each other. The braided nylon achieves a very satisfactory result in this regard. Accordingly, the use of such a string facilitates the re-establishment of proper yo-yo operation if the two string segments happen to become twisted about each other.

It should be noted that the present invention can be constructed with or without the arms 17 which support the loop member 18. The protective loop member 18 can be attached to, and lie below, the pulley 12. The loop 18 limits the extent of upward travel of the yo-yo body 1. This avoids the possibility of the string being knocked out of the pulley trough 13 when the yo-yo body 1 rises sufficiently high. The string can also be prevented from being knocked out of the pulley trough 13 by placing a loop around the pulley 12, rather than below it.

Figure 7:
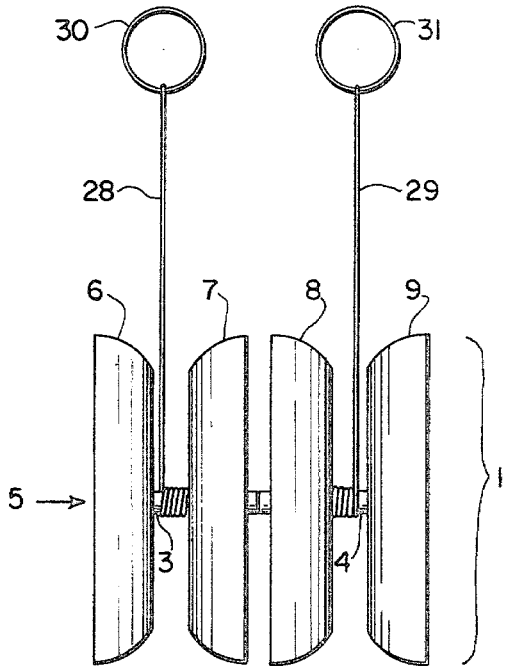
FIG. 7 is a plain front view of another embodiment of the present invention having two separate strings.

FIG. 7 shows a plain front view of another embodiment of the present invention, possessing a string 28, and a second, separate string 29. A ring 30 is attached to string 28, and a second ring 31 is attached to string 29. Alternatively, string 28 may be attached to ring 56 and string 29 may be attached to ring 57 of the support member illustrated in FIG. 6.

It is possible to fabricate the body 1 of the yo-yo from a variety of materials, such as wood; plastic; metal; etc. The body 1 of the yo-yo could be manufactured in various ways; for example, the axle 2, consisting of two connected but freely rotating parts 3 and 4, could be prepared separately. The discs 6, 7, 8 and 9 could also be prepared separately and then mounted on the axle 2, or connected by means of the arms 27 and axle-segments 3 and 4.

Another possibility would be to manufacture the two halves of the device separately; each half would be similar to a conventional yo-yo body. The two halves could then be attached to each other by inserting one end of a swivel into one axle-segment, and the other end of the swivel into the other axle-segment.

Figure 8:
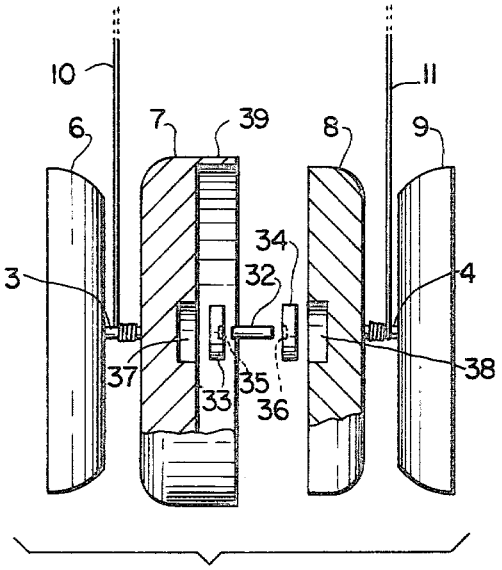
FIG. 8 is an exploded front view of another embodiment of the present invention containing radial bearing systems, and illustrating a means for preventing the string from entering the space between discs 7 and 8.

Another embodiment of the present invention is illustrated in exploded form in FIG. 8. This consists of one portion, comprised of axle-segment 3 and discs 6 and 7, resembling a conventional yo-yo body; and a second portion, consisting of axle-segment 4 and discs 8 and 9, also resembling a conventional yo-yo body. Two radial bearing systems 33 and 34, containing ball-bearings or roller bearings within a circular race are interconnected by a rod 32 which is firmly inserted into the bores 35 and 36 of both bearing systems 33 and 34, respectively. All three parts are held together by attaching bearing system 33 to disc 7 and bearing system 34 to disc 8 in such a manner that discs 6 and 7 can rotate independently of discs 8 and 9. This may be facilitated by having cylindrical cavities 37 and 38 in discs 7 and 8, respectively. Bearing system 33 is firmly inserted into cavity 37, and bearing system 34 is firmly inserted into cavity 38. Alternatively, only a single bearing system, positioned between discs 7 and 8, may be utilized. For example, a bearing system 33 may be attached to disc 7 in the manner explained above; the rod 32 may then be centrally connected to disc 8, directly. Again, in this case, discs 6 and 7 can rotate independently of discs 8 and 9.

Disc 7 in FIG. 8 contains a circular lip 39 which overlaps, or partially overlaps, disc 8, in the assembled yo-yo. This prevents the string 10, 11 from entering the space between discs 7 and 8 during operation of the yo-yo device. A similar lip 39 can also be included in the embodiments illustrated in FIGS. 1, 3, and 7.

The various components could be fastened together by various means, including but not limited to gluing; screwing; wedging; soldering; welding; etc.

The oppositely-rotating sections of the yo-yo device of the present invention provide scope for introducing ornamental design features not possible with the conventional yo-yo; sections of the design will be moving in opposite directions during operation of the yo-yo device, thereby kinetically enhancing the design patterns.

The inventor has found that a device using a linear glass-blower's swivel of 6 millimeter diameter, as axle, with two discs each of 55 millimeter diameter attached to one segment of the swivel, and two similar discs attached to the other segment of the swivel, to function well as a precession-resistant yo-yo device. In this particular embodiment, the distance between disc 6 and 7 was 1.5 millimeters; and discs 8 and 9 were separated from each other by a similar distance. There was a 1 millimeter gap between discs 7 and 8. Limp, braided nylon, supported on a pulley system and suspended from a swivel system and a holding ring, was used in this device. A similar device using a support member as illustrated in FIG. 6 also worked very well.

Figure 9:
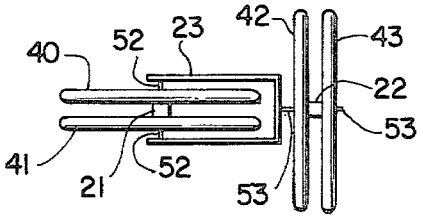
FIG. 9 shows an embodiment which is an obvious extension of the ideas embodied in this invention, where the two axle-segments do not lie on a common axis.

The instant invention is shown and described herein in what is considered to be the most practical, and preferred, embodiments. It is recognized, however, that departures may be made therefrom which are within the scope of the invention, and that obvious modifications will occur to one skilled in the art. For example, as a result of the invention of the tape-supported yo-yo described in my copending U.S. patent application Ser. No. 138,729, filed Apr. 9, 1980, an obvious extension of the present invention is to substitute tape for the string 10, 11 in the present invention. Furthermore, once the idea of axle-segments whose rotation is separately controlled by opposite ends of a single string has been described in the present patent application, it is an obvious step to consider such yo-yo devices as described herein where the axle-segments do not lie on a common axis. A possible embodiment of such a device is illustrated in FIG. 9. Discs 40 and 41 are mounted on axle-segment 21; discs 42 and 43 are mounted on axle-segment 22. A light-weight frame 23 holds the two axle-segments 21 and 22 in a fixed relative position. Opposite ends of a single string can be connected to axle-segments 21 and 22. A rotatable pin 52 connects axle-segment 21 to the frame 23; and a rotatable pin 53 connects axle-segment 22 to the frame 23. The precessional behavior of the embodiment illustrated in FIG. 9 will be different from those embodiments illustrated in FIGS. 1, 3, 5, 7 and 8.

Figure 10:
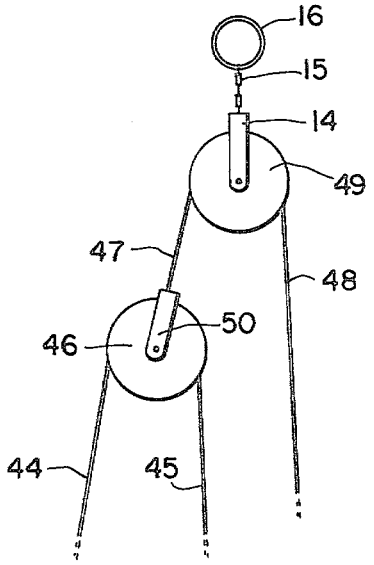
FIG. 10 shows how the ideas embodied in this invention can be readily extended to three rotating axle-segments.

Finally, it is a simple and obvious matter to extend the ideas embodied in this invention to three, four or more independently-rotating axle-segments by using string configuration and support member systems as indicated in FIG. 10. In FIG. 10, 44 and 45 are two segments of a single string which is looped over a pulley 46; 47 and 48 are two segments of a single string which is looped over pulley 49. The end of string segment 47 is connected to the frame member 50 for pulley 46. The three free ends of the two strings 44, 45 and 47,48 are then attached to three axle-segments. These ideas are readily extended to any number of axle-segments, which may be positioned on a common axis or on different axes; and other support means, besides pulleys, may be used in these devices.

I claim:

1. A toy capable of combined rotational, translational and orbital motion, comprising:
- a first and second axle positioned on a common axis and connected to each other such that each axle is capable of independent rotation;
- a first and second disc, each connected at its center point to the first axle;
- a third and fourth disc, each connected at its centerpoint to the second axle; and
- a single string connected at a first end to said first axle between said first and second discs and connected at a second end to said second axle between said third and fourth discs.

2. A toy capable of combined rotational, translational and orbital motion, comprising:
- a first axle;
- a first and second disc connected at their centerpoints to said first axle;
- a second axle;
- a third and fourth disc connected at their centerpoints to said second axle, said third disc being rotatably connected to said first disc; and
- a single string connected at a first end to said first axle between said first and second discs and connected at a second end to said second axle between said third and fourth discs.

3. A toy capable of combined rotational, translational and orbital motion, comprising:
- a first axle;
- a second axle positioned on a different axis from said first axle and connected to said first axle, said first and second axles capable of rotating independently of each other;
- a first and second disc connected to said first axle at their centerpoints;
- a third and fourth disc connected at their centerpoints to said second axle; and
- a single string connected at a first end to said first axle between said first and second discs and connected at a second end to said second axle between said third and fourth discs.

4. A toy capable of combined rotational, translational and orbital motion, comprising:
- a rod having a first and second end;
- a first bearing having a bore wherein said first end of said rod is inserted;
- a second bearing having a bore wherein said second end of said rod is inserted;
- a first disc having a first face connected to said first bearing and a second face connected to a first axle connected to a second disc;
- a third disc having a first face connected to said second bearing and a second face connected to a second axle connected to a fourth disc, such that said first and second discs may rotate independently of said third and fourth discs.

5. A toy capable of combined rotational, translational and orbital motion, comprising:
- a rod having a first and second end;
- a bearing having a bore wherein said first end of said rod is inserted;
- a first disc having a first face connected to said bearing and a second face connected to an axle connected to a second disc such that said rod may rotate independently of said first and second discs;
- a third disc having a first face connected to said second end of said rod and a second face connected to a second axle connected to a fourth disc.

6. A toy capable of combined rotational, translational and orbital motion, as claimed in any of claims 1, 2, 4, or 5 wherein said first disc overlaps said third disc.

7. A toy capable of combined rotational, translational and orbital motion, as claimed in any of claims 4 or 5, further comprising:
- a first string having an end connected to said first axle between said first and second discs;
- a second string connected to said second axle between said third and fourth discs.

8. A toy capable of combined rotational, translational and orbital motion, as claimed in claim 7, further comprising:
- a first holding means attached to said first string;
- a second holding means attached to said string.

9. A toy capable of combined rotational, translational and orbital motion, as claimed in any of claims 1, 2, 4 or 5, further comprising:
- a single string connected at a first end to said first axle between said first and second discs and connected at a second end to said second axle between said third and fourth discs.

10. A toy capable of combined rotational, translational and orbital motion, as claimed in claim 9, further comprising a support comprised of a ring, a swivel system in connection with said ring, a first and a second connecting means connected to and extending from said swivel system, and a second ring connected to said first connecting means and a third ring connected to said second connecting means such that said single string may be looped through said second ring and said third ring.

11. A toy capable of combined rotational, translational and orbital motion, as claimed in claim 9, further comprising:
- a rotatably mounted support means over which said string may be supported.

12. A toy capable of combined rotational, translational and orbital motion, as claimed in claim 11, further comprising:
- a swivel system connected to said support means; and
- a holding means connected to said swivel system.

13. A toy capable of combined rotational, translational and orbital motion, as claimed in claim 11 wherein said rotatably mounted support means is a rotatably mounted pulley system.

14. A toy capable of combined rotational, translational, and orbital motion, as claimed in claim 13, further comprising:

a support arm extending from said rotatably mounted pulley system;

a loop connected to said support arm, said loop being positioned in a plane normal to said pulley system and being positioned around said string.

15. A toy capable of combined rotational, translational and orbital motion, as claimed in any of claims 4 or 5, further comprising:

a single tape connected at a first end to said first axle between said first and second discs and connected at a second end to said second axle between said third and fourth discs.

16. A toy capable of combined rotational, translational and orbital motion, as claimed in claim 15, further comprising:

a rotatably mounted support means over which said tape may be supported.

17. A toy capable of combined rotational, translational and orbital motion, as claimed in claim 16, further comprising:

a swivel system connected to said support means; and a holding means connected to said swivel system.

18. A toy capable of combined rotational, translational and orbital motion, as claimed in claim 16 wherein said rotatably mounted support means is a rotatably mounted pulley system.

19. A toy capable of combined rotational, translational and orbital motion, as claimed in claim 18, further comprising:

a support arm extending from said rotatably mounted pulley system;

a loop connected to said support arm, said loop being positioned in a plane normal to said pulley system and being positioned around said tape.

20. A toy capable of combined rotational, translational or orbital motion comprising:

a first and second axle positioned on a common axis and connected to each other such that each axle is capable of independent rotation;

a first and second disc, each connected at its centerpoint to the first axle;

a third and fourth disc, each connected at its centerpoint to a second axle; and a tape connected at a first end to said first axle between said first and second discs and connected at a second end to said second axle between said third and fourth discs.

21. A toy capable of combined rotational, translational and orbital motion, comprising:

a first axle;

a first and second disc connected at their centerpoints to said first axle;

a second axle;

a third and fourth disc connected at their centerpoints to said second axle, said third disc being rotatively connected to said first disc; and a tape connected at a first end to said first axle between said first and second discs and connected at a second end to said second axle between said third and fourth discs.

22. A toy capable of combined rotational, translational and orbital motion, comprising:

a first axle;

a second axle positioned on a different axis from said first axle and connected to said first axle, said first and second axles capable of rotating independently of each other;

a first and second disc connected to said first axle at their centerpoints;

a third and fourth disc connected at their centerpoints to said second axle; and a tape connected at a first end to said first axle between said first and second discs and connected at a second end to said second axle between said third and fourth discs.

* * * * *